US011167911B2

(12) United States Patent
Tecchiolli et al.

(10) Patent No.: US 11,167,911 B2
(45) Date of Patent: Nov. 9, 2021

(54) FLUID SUBSTANCE DISPENSING DEVICE

(71) Applicant: Coster Tecnologie Speciali S.p.A., Calceranica al Lago (IT)

(72) Inventors: Alfeo Tecchiolli, Meano (IT); Valentino Stenghel, Caldonazzo (IT); Loris Schmid, Calceranica al Lago (IT)

(73) Assignee: COSTER TECHNOLOGIE SPECIALI S.P.A., Calceranica Al Lago (IT)

( * ) Notice: Subject to any disclaimer, the term of this patent is extended or adjusted under 35 U.S.C. 154(b) by 0 days.

(21) Appl. No.: 17/005,415

(22) Filed: Aug. 28, 2020

(65) Prior Publication Data

US 2021/0070531 A1 Mar. 11, 2021

(30) Foreign Application Priority Data

Sep. 6, 2019 (IT) ..... 102019000015830

(51) Int. Cl.

| | |
|---|---|
| ***B65D 83/00*** | (2006.01) |
| ***B65D 83/42*** | (2006.01) |
| ***B65D 83/54*** | (2006.01) |
| ***B65D 83/62*** | (2006.01) |
| ***B05B 11/00*** | (2006.01) |
| ***B05B 11/04*** | (2006.01) |

(52) U.S. Cl.

CPC ..... *B65D 83/0055* (2013.01); *B05B 11/0067* (2013.01); *B05B 11/047* (2013.01); *B65D 83/425* (2013.01); *B65D 83/54* (2013.01); *B65D 83/62* (2013.01)

(58) Field of Classification Search

CPC .... B65D 83/0055; B65D 83/54; B65D 83/62; B65D 83/425; B05B 11/0067; B05B 11/047

See application file for complete search history.

(56) References Cited

U.S. PATENT DOCUMENTS

| | | | | |
|---|---|---|---|---|
| 2,968,427 A | | 1/1961 | Meshberg | |
| 3,352,464 A | | 11/1967 | Frangos | |
| 3,770,170 A | * | 11/1973 | Hayes | B65D 83/30 222/402.11 |

(Continued)

FOREIGN PATENT DOCUMENTS

| | | |
|---|---|---|
| FR | 1547768 A | 11/1968 |
| GB | 872187 A | 7/1961 |

*Primary Examiner* — Frederick C Nicolas

(74) *Attorney, Agent, or Firm* — Dickinson Wright PLLC; Andrew D. Dorisio

(57) ABSTRACT

A device for dispensing a fluid substance includes a pressurised container associated with a dispensing valve featuring a supply conduit and a stem endowed with a cavity through which the fluid substance is dispensed, a chamber housed inside the container, and arranged so as to surround at least part of the body of the valve, the chamber delimited by a deformable wall and at least part of the body, the valve being of the three-way type, configured so that when the stem is in a first position, the cavity is isolated from the supply conduit and from the chamber, while the supply conduit is in communication with the chamber, wherein when the stem is in a second position, the cavity is in communication with the chamber, and wherein when the stem is in a third position, the cavity of the stem is in communication with at least the supply conduit.

18 Claims, 5 Drawing Sheets

(56) References Cited

U.S. PATENT DOCUMENTS

| | | | | | |
|---|---|---|---|---|---|
| 4,858,790 | A * | 8/1989 | Howlett | B65D 83/54 | 222/402.2 |
| 4,863,074 | A * | 9/1989 | Quennessen | B65D 83/206 | 222/402.13 |
| 4,919,312 | A * | 4/1990 | Beard | B65D 83/54 | 222/107 |
| 4,953,759 | A * | 9/1990 | Schmidt | B65D 83/54 | 222/402.2 |
| 5,007,556 | A * | 4/1991 | Lover | B65D 83/54 | 222/1 |
| 5,037,013 | A * | 8/1991 | Howlett | B65D 83/54 | 222/402.2 |
| 5,579,955 | A * | 12/1996 | Sandou-Pascal | B65D 83/34 | 222/105 |
| 6,196,276 | B1 * | 3/2001 | De Laforcade | B65D 83/425 | 141/20 |
| 6,454,140 | B1 * | 9/2002 | Jinks | B65D 83/54 | 222/402.2 |
| 6,681,955 | B2 * | 1/2004 | Rosenbaum | B65D 83/38 | 222/107 |
| 6,698,620 | B2 * | 3/2004 | Ogata | B65D 83/0061 | 141/20 |
| 6,971,556 | B2 * | 12/2005 | Shadwell | B65D 83/38 | 222/402.1 |
| 8,317,062 | B2 * | 11/2012 | Bodet | B65D 83/425 | 222/95 |
| 8,505,774 | B2 * | 8/2013 | Nimmo | B65D 83/62 | 222/94 |
| 8,752,731 | B2 * | 6/2014 | Nimmo | B65D 83/38 | 222/1 |

* cited by examiner

FLUID SUBSTANCE DISPENSING DEVICE

This application claims priority to Italian Patent Application No. 102019000015830 filed on Sep. 6, 2019, which is incorporated herein by reference.

FIELD OF THE INVENTION

The present invention relates to a device for dispensing a fluid substance.

In particular, it refers to a device for dispensing, by means of a valve, a fluid substance contained in a pressurised container.

BACKGROUND ART

A device is known, for example from GB 872,187 A, which dispenses a fairly volumetrically stable dose of a fluid substance contained within a pressurised container.

One drawback of the known device lies in the difficulty of filling the container with the substance to be dispensed and in the pressurisation of the container.

In fact, some of the canisters are unable to withstand the filling/pressurisation operations and have to be discarded.

SUMMARY OF THE INVENTION

The object of the present invention is to provide a fluid substance dispensing device which is improved compared with the prior art.

A further object of the invention is to provide a device that makes the pressurisation and filling with the fluid substance easier.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

Figure 1:
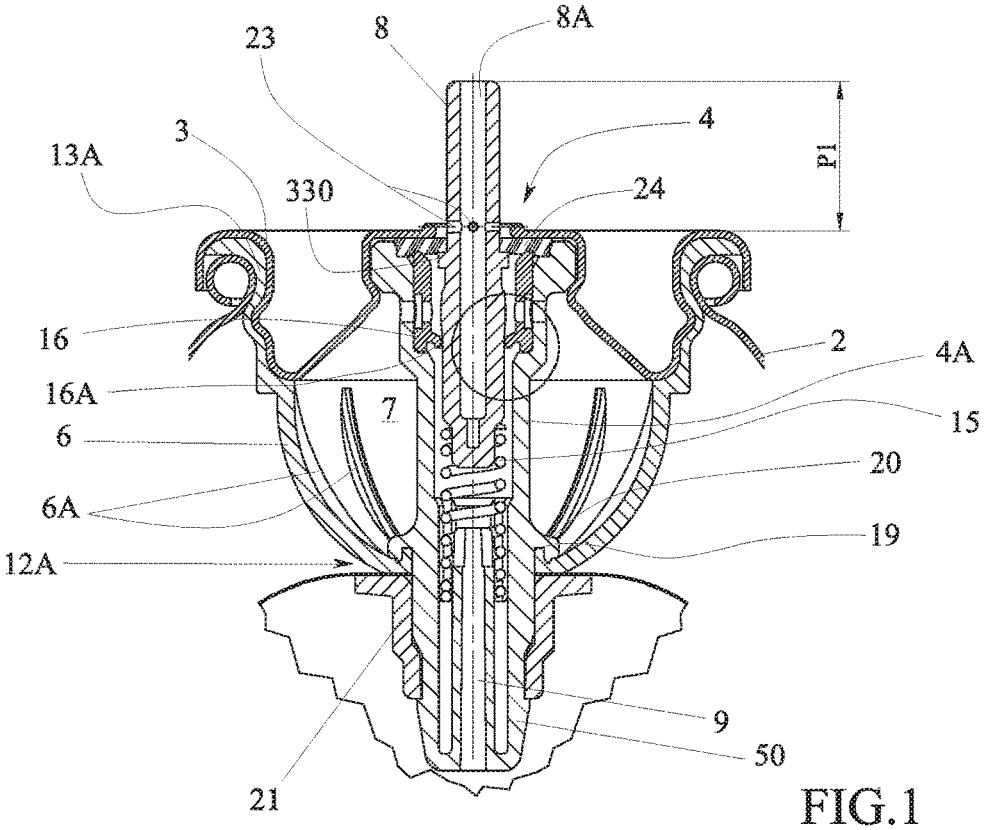
FIG. 1 is a section view of a device according to the present invention, in a resting position.

With reference to the figures stated, reference number 1 is used to denote, as a whole, a fluid substance dispensing device.

The device 1 comprises a pressurised container 2, in which the fluid substance to be dispensed can be directly positioned, or, as in the case shown in the drawings, inside which a deformable bag 5 may be contained which houses the said substance.

The container 2 is coupled with a dispensing valve 4 by means, for example, of a bottom 3 which is hermetically fixed to the container 2, to which the valve 4 may, in turn, be permanently fixed.

The valve 4 has a supply conduit 9 which can be in direct communication with the interior of the deformable bag 5, or, for example, in communication with the bottom of the container 2 through a suction tube.

The valve also has a stem 8 endowed with a cavity 8A through which the fluid substance is dispensed.

The stem 8 is movable inside a valve body 4A with counterforce provided by a spring 15 and cooperates with at least one gasket 16 which controls the dispensing of the fluid substance, as will be better described below.

In any case, during use, the stem (or rather the end part thereof) is coupled to a dispensing cap 33, which may be a flat cap or a spout cap, etc., depending on the substance to be dispensed and the desired dispensing methods.

When the user depresses the stem (via the dispensing cap), this results in the fluid substance being dispensed through the cavity 8A of the said stem.

Continuing with the description, it should be noted that inside the container 2 there is a chamber 7.

The chamber 7 is arranged so as to surround the entire perimeter of at least a part of a body 4A of the valve 4, and is delimited externally (towards the container) by a deformable wall 6 and internally (towards the stem) by at least one part of the body 4A.

Figure 6:
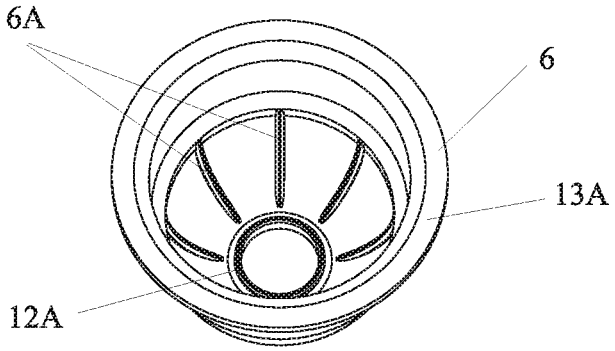
FIGS. 6 and 7 show details of the device in FIG. 1.
Figure 7:
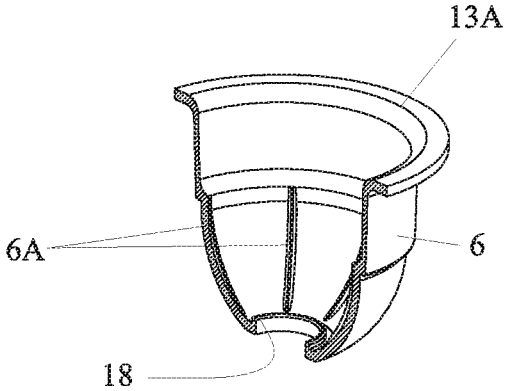

The deformable wall may be essentially a cup made of an elastic material, as clearly visible in FIGS. 6 and 7.

In this document, the term 'elastic material' means a material capable of recovering its original shape (i.e. that of the extended cup shown in FIGS. 6 and 7) by virtue of its elasticity, and also in the absence of external forces extending the cup.

Elastic materials of which the deformable wall 6 may be made include (among others): BR (butadiene rubber), NBR, SBR, EPDM, IR, IIR (Butyl), CR (Chloroprene), CIIR (Chlorobutyl), FBM (Fluoride), PU, Silicone, TPE/TPR.

Inside the deformable wall 6 (or membrane) there may be a film made of a multi-layer or single material (not shown) having a propellant barrier function that prevents contact between the product and the material of which the membrane is made. In the event of a multi-layer film, one of the layers can act as a barrier. Examples of usable structures include (among others): PET/Evoh/PE, PET/Evoh/PP, multi-structure, single or bi-material PP or PE.

The film may be sandwiched between the membrane 6 and the bottom 3 in the upper area (on the bottom); in the lower area it can be fixed to the base of the valve body, for example at the groove 19.

It is still possible to fix the film by means of a snap mechanism between the two pieces or by direct gluing to the membrane 6 or by gluing or welding to the external surface of the valve.

In order to create a barrier layer which isolates the membrane from the product, at least one wall thereof may be covered with a suitable coating.

Examples of coating may include: Halogenation, lubricant-based treatments consisting of resins and PTFE (for example spray-deposition), plasma treatments (PECVD, i.e. plasma enhanced chemical vapour deposition)—which offer the advantage of creating a very thin coating—or parylene treatments.

For example, the deformable wall 6 may be made as a single piece, by moulding.

As can be seen from the drawings, to improve the elastic return to a relaxed position, the deformable wall 6 can have ribs 6A. Specifically, there is a plurality of ribs 6A (at least two) configured to extend the deformable wall 6 inside the container 2.

In the present text, the term 'rib' means a thickened area in the material of which the deformable wall 6 is made. Obviously, the same technical effect may also be used through technical equivalents that lend the membrane elasticity which is effective in the system according to the present invention.

In the configuration in FIG. 1, the deformable wall 6 comprises at least a first portion 12A (or end) fixed firmly to the valve body 4A.

In this document, the term "permanently fixed in a sealed manner" means that the first portion 12A is fixed to the valve body 4A, or to a part attached to the valve body (for example a suction tube) so that the seal is guaranteed even when there is a slightly higher pressure inside the chamber 7 than inside the container 2.

For example, the first portion 12A may have a lip 18 configured to mate with a groove 19 envisaged on a first flange 20 of the valve body 4A.

The first portion 12A is then sandwiched between the flange 20 on the valve body 4A and a fixing collar 21 which engages via a snap mechanism (or in another known way) with the valve body 4A. The collar 21 may be snap-fitted onto the valve body 4A by means of snap hooks 50.

In the configuration described in FIG. 1, there is only one collar 21, directly welded to the bag 5, which cooperates with the hooks 50. In order to make the bag 5 more dimensionally stable, especially when containing large amounts of fluid substance, the bag maybe welded to a sealing ring (not shown). During assembly, the sealing ring remains sandwiched between the collar 21 or insert (positioned inside the bag) and the bottom of the membrane 6 against which the ring presses directly.

The first portion 12A may also be fixed in another known way, such as by welding, gluing, etc.

Advantageously, the fixing collar 21 may be the collar of the deformable bag 5, as illustrated in FIG. 1, to which the bag is conventionally welded.

The second portion 13A of the deformable wall 6 may, instead, be sandwiched between a bottom 3 to which the valve 4 and the container 2 are fixed (in a conventional manner).

For example, if the bottom 3 is made of metal, it can simply be crimped onto the container. The seal between the bottom and the container is improved by the very presence of the deformable wall 6, which acts as a seal.

In the present invention, the valve 4 is of the three-way type.

Figure 4:
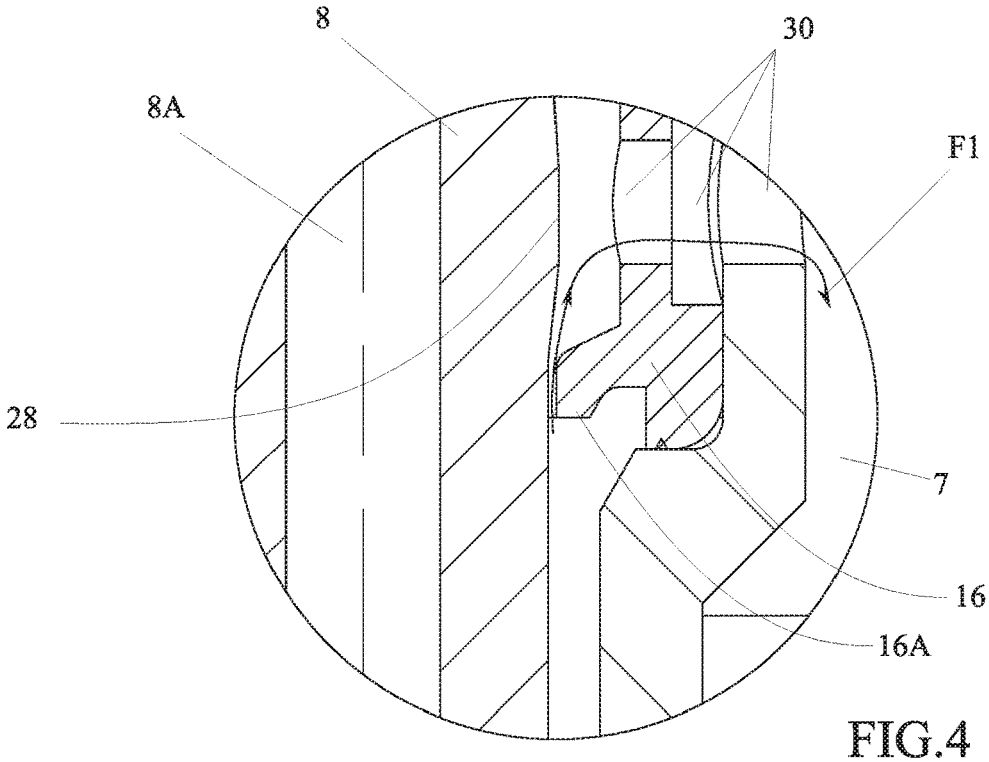
FIG. 4 represents the detail enclosed in the circle in FIG. 1, in a resting step following the dispensing step.

When the stem 8 is in a first position, for example the resting position, as shown in FIG. 1, the cavity 8A therein is isolated from the supply conduit 9 and from the chamber 7, while the supply conduit 9 is in communication with the chamber 7 (see FIG. 4).

In the resting position, the small holes 23 are above the lip of the gasket 24, or in any case isolated from the interior of the valve body 4A. This way, dispensing is prevented.

Furthermore, as can be seen clearly in FIG. 4 and as has already been mentioned, the supply conduit 9 is in communication with the chamber 7 (see FIG. 4). This way, the chamber 7 is full of the fluid substance to be dispensed. It should be noted that the chamber 7 is subject to the pressure present inside the chamber 2, which is the same as that to which the bag 5 is subject (if present) or the same as that to which the fluid substance is subject inside the container (if the bag is not present).

When the stem 8 is pressed to bring it into the second position, the cavity 8A is placed in communication solely with the chamber 7.

Figure 2:
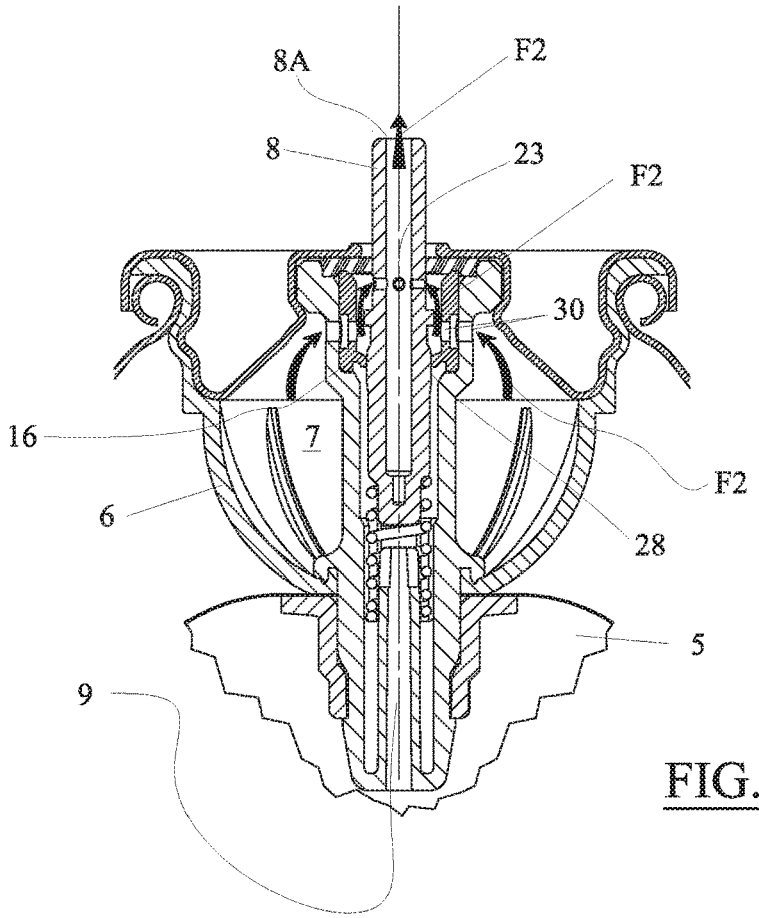
FIG. 2 and FIG. 3 show, in section views, the device in respectively a start-of-dispensing step and an end-of-dispensing step.

In fact, as can be seen in FIG. 2, the small holes 23 are internal to the valve body, while a slight bulge 28 on the stem (which, in the first position, was uncoupled from the first gasket 16), cooperates therewith to isolate the supply conduit 9.

Figure 3:
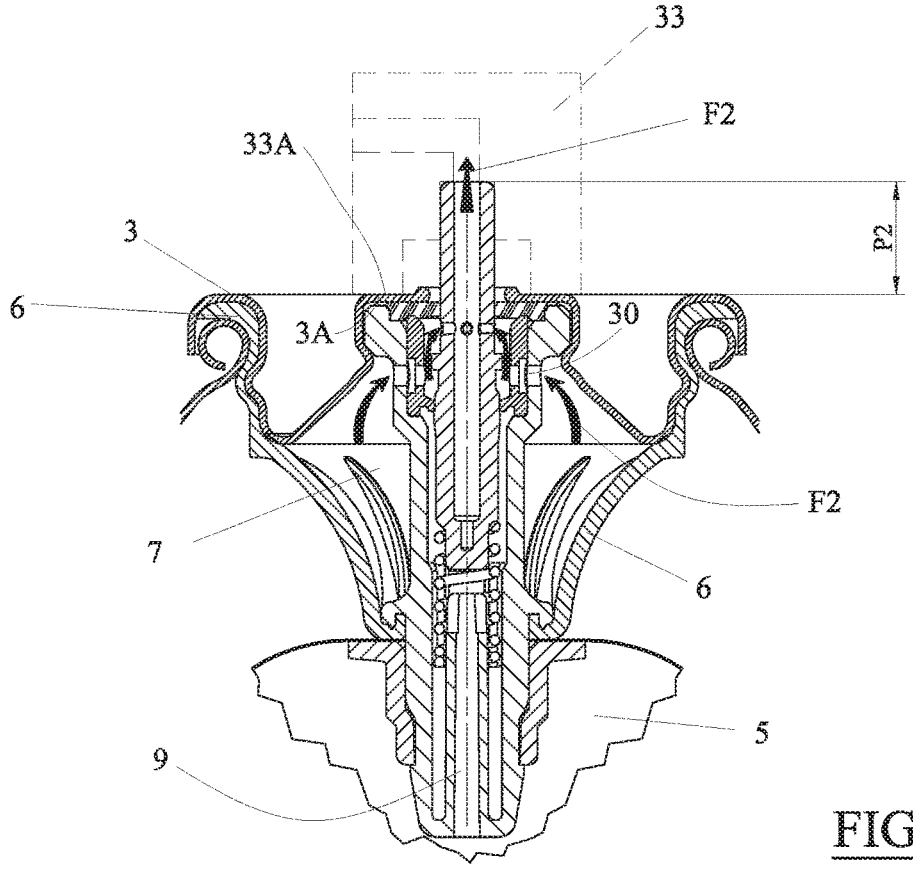

The substance present inside the chamber 7 is therefore dispensed through the cavity 8A, which it reaches by flowing, in sequence, through the openings 30, inside the valve body 4A, and through the small holes 23 in the stem 8. See, more specifically, the route shown by the arrows F2 in FIGS. 2 and 3.

When the stem 8 is in the second position, the pressure inside the container 2 (obtained, for example, through pressurisation with nitrogen, or another suitable gas) presses against the deformable wall 6, expelling the fluid substances contained inside the chamber 7 and pushing the wall so that it is essentially in contact with the outside of the valve body 4A. In this position, which occurs a few moments after that shown in FIG. 3, almost all of the fluid substance contained in the chamber 7 is dispensed and therefore the said dispensing is interrupted since the chamber 7 (the only one in communication with the cavity of the stem) reaches the maximum deformation thereof.

In this configuration, it must be underlined how important the ribs (if present) on the membrane, better defined above, are. The presence of the ribs may also have a regulating effect on the amount of residual fluid inside the chamber 7, limiting the maximum deformation of the membrane 6 in the end-of-dispensing condition.

During use, at this point, the user releases the stem which returns, through the action of the spring 15, to the first position in FIG. 1, with a second flange 330 on the stem in contact with the gasket 24.

In this configuration, as already said, the chamber 7 is in communication with the supply conduit 9, and the wall 6 of the chamber 7, due to the elasticity thereof, returns to the relaxed position, thereby recalling the fluid substance inside it to allow further dispensing.

As can easily be understood from the description above, the presence of the chamber 7 therefore allows 'dosed' dispensing of a specific volumetric quantity of fluid substance, similar to that performed by a pump, but with all the advantages of a pressurised valve system.

The filling of the container (or of the deformable bag 5 if present) with the fluid substance to be dispensed takes place following the pressurisation of the said container 2.

Figure 5:
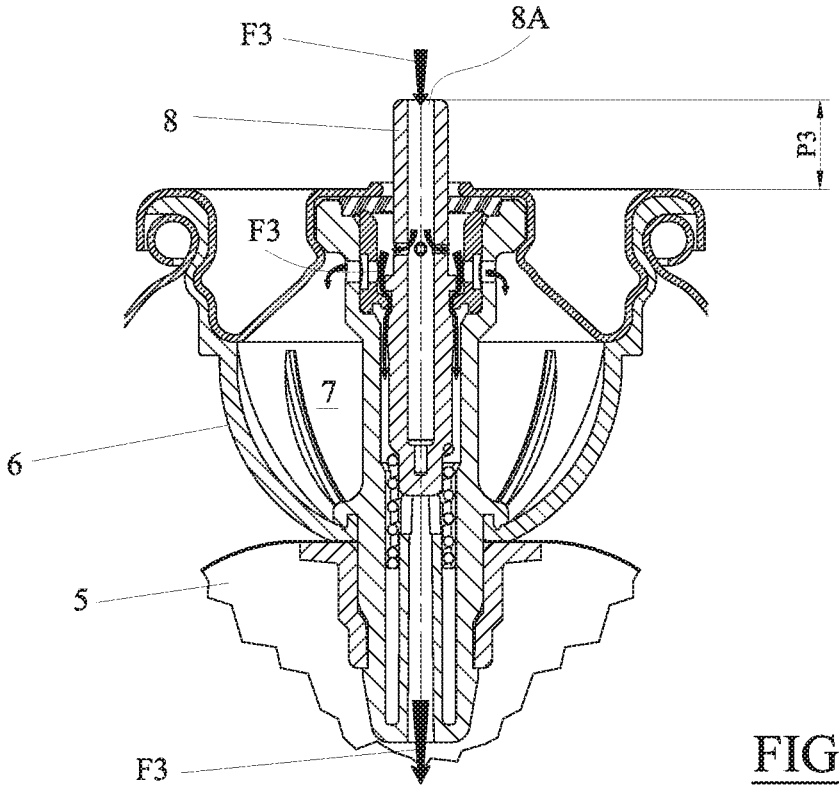
FIG. 5 represents the device in a step for filling with the fluid substance.

The filling can therefore take place through the cavity 8A in the stem 8, thereby pushing the latter into a third position (the position shown in FIG. 5).

In this position, the cavity 8A inside the stem is in communication with at least the supply conduit 9.

In fact, as can be seen in FIG. 5, the bulge 28 on the stem is pushed below the seal 16 and therefore the cavity 8A in the stem is in communication (arrows F3) with the supply conduit 9 and with the interior of the chamber 7.

This way, the container (or the bag 5, if present) can be filled through the said cavity in the stem 8. Obviously, to carry out the filling, it will be necessary to inject the fluid substance through the cavity 8A, at a higher pressure than that present inside the container 2.

Figure 9:
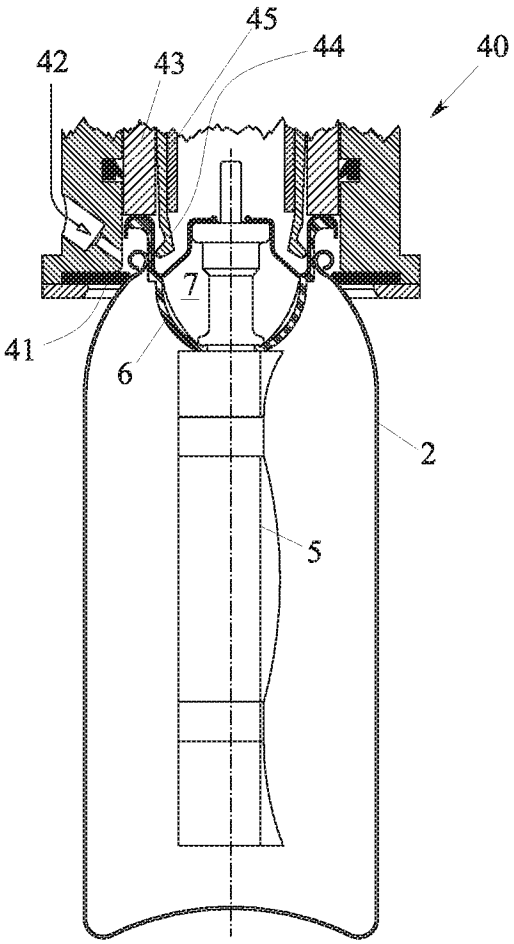

It should be mentioned that, in the presence of a deformable bag 5, it will be necessary to pressurise the container 2 beforehand, for example before fixing the bottom 3, as shown in FIG. 9.

For example, the deformable bag 5 is in a wound up arrangement. The deformable wall 6 (or cup) is fitted on the bottom 3 and on the valve body 4A and the bag is inserted (for example, by snap-fitting onto the valve body 4A).

In FIG. 9, for the sake of illustration simplicity, the deformable wall 6 is in an 'extended' or expanded position. However, if a vacuum is created inside the bag (and therefore also inside the membrane), also to facilitate a pre-assembly seal check, the membrane will be flattened close to the pump body, and therefore with a different configuration from that shown in FIGS. 8 and 9.

Figure 8:
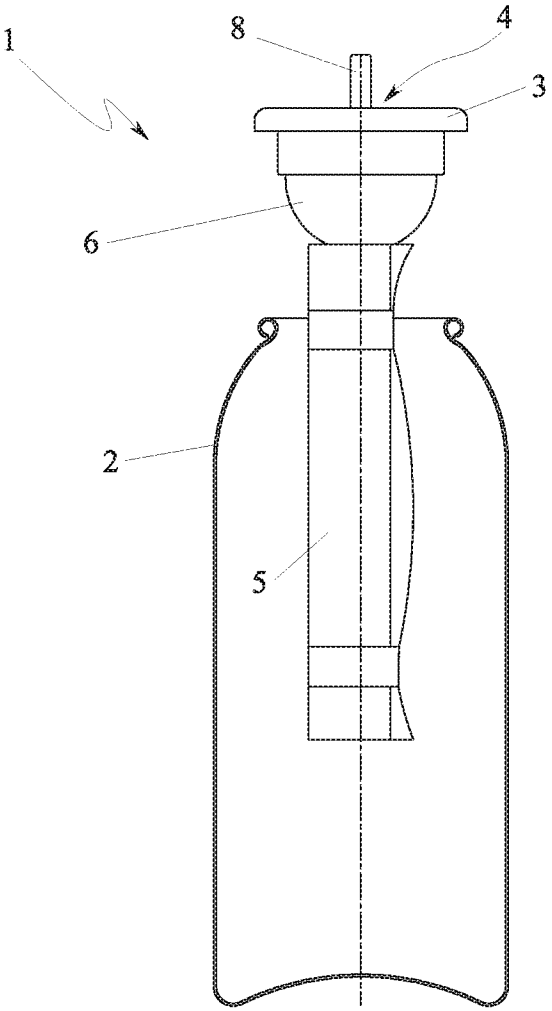

Then, as shown in FIG. 8, everything is inserted into the container 2.

A fixing and pressurising head 40 is then brought close to the mouth of the container and to the bottom.

It has seals 41 on the body of the container and pressurises (for example through the hatch 42) the compartment inside the container 2. Subsequently, a press 43 pushes the bottom 3 onto the container and the tips 44 crimp the bottom along the free edge of the container, which extends radially from the tubular element 45 which falls over the tips.

Figure 10:
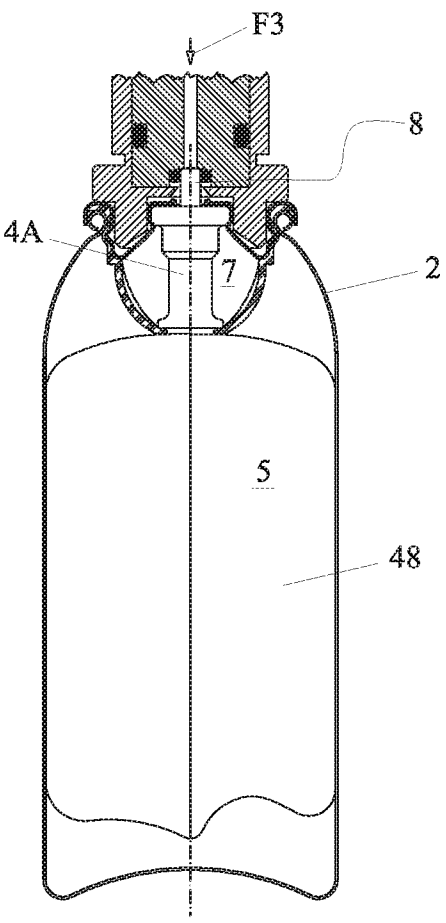
FIGS. 8, 9, and 10 show the pressurisation and filling steps for the device in FIG. 1.

Subsequently, as shown in FIG. 10, it is possible to move to another station (which may also be available to the end customer) which pushes the stem up to the third position to allow filling (arrow F3) with the fluid substance 48.

In the absence of a deformable bag 5, the pressurisation and filling (or filling and pressurisation) steps may be envisaged by exploiting the third position of the stem 8, in an essentially conventional manner.

It should be noted that the third position of the stem 8 may never be reached during normal use by a user since the dispensing button 33 can be positioned on the stem (for example as shown simply in a schematised view in FIG. 3) which features a part 33A which comes into contact with a corresponding part of the bottom 3A (or other part of the container 2). This way, the stem stroke is limited to the second position, in which metered dispensing of the fluid substance takes place.

Advantageously, in the first position, the free end of the stem has a height P1 (with respect to the bottom) which is greater than the height of the stem 8 in the second position P2, which is still greater than the height P3 of the stem in the third position.

In one possible embodiment of the device, the cap may feature a movable portion (which can be coupled with the part 33A), which, for example, by means of rotation or translation, selectively limits the stem stroke. Using the cap, it is possible to select the 'allowed' stem stroke, in order to move into the second or third position. It is therefore possible to have metered or continuous dispensing of the fluid substance, at will, simply using the dispensing cap (for example by rotating it) to select the stem stroke. It is also possible to envisage a closed position in which the stem cannot move, and therefore dispensing is prevented, even in the presence of a force exerted upon the dispenser cap.

A possible configuration of the three-way valve is illustrated in the description set out above. In this configuration, the stem 8 of the valve 4 is integral with a bulge 28, and the bulge 28 can be moved above the gasket 16 or below the gasket 16 so that a seal is not allowed, or in contact with the gasket 16 (or better with an annular lip 16A thereof) so that the bulge forms a seal on the gasket 16.

Obviously, the bulge 28 can be made in one piece with the stem (as visible in the embodiment in FIG. 1) or as a single piece which is separate from the stem and secured to it (see, for example, FIG. 11, which will be better described below).

In this document, the term "bulge" means a portion of the stem (or a part solidly coupled therewith) which features a larger section than that of the neighbouring sections. For example, the 'bulge' may also be obtained by creating channels directly above and below a section 28 intended to form a seal on the gasket 16 (and in particular with the annular sealing lip thereof).

In the wording above, a chamber 7 has been described which is formed from a 'cup' made of an elastic material.

Figure 12:
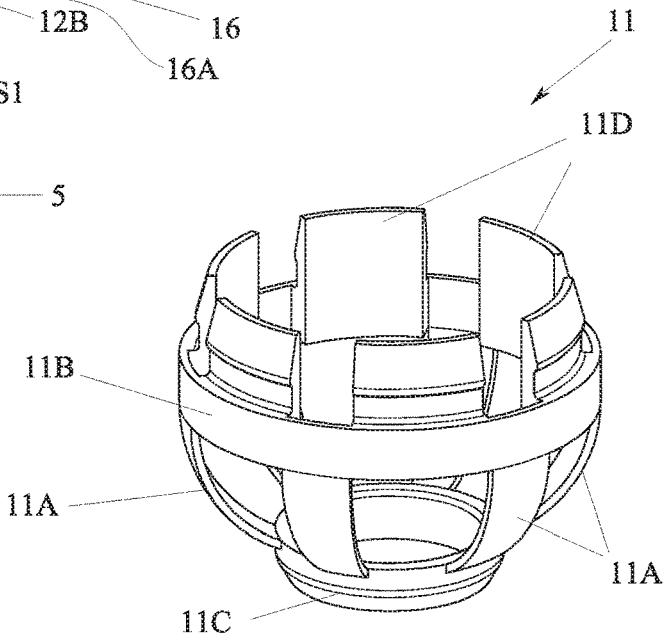
FIG. 12 and FIG. 13 show a detail of the device in FIG. 11.
Figure 13:
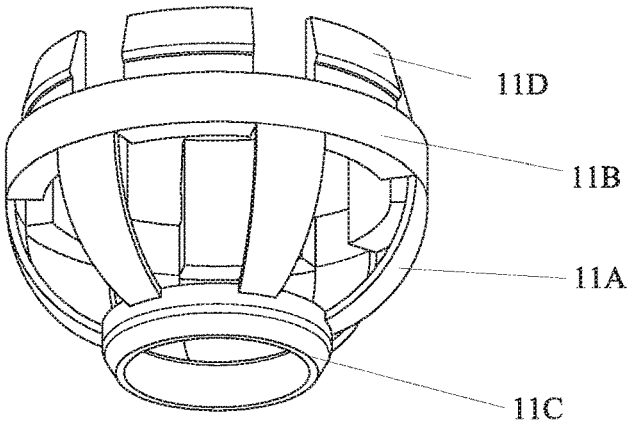

However, the chamber 7 can also be made in other ways. A particularly convenient one is shown in FIGS. 11, 12, and 13.

In these, the same reference numbers used earlier are used to denote parts that are functionally similar to those already illustrated. They will not, therefore, be described again.

It is immediately clear that, in this solution, the deformable wall 6 is formed of a multi-layer film, which is preferably the same as or similar to that of which the deformable bag 5 is formed. Since, unlike the elastic wall in the solution described above, this deformable wall 6 does not have elasticity characteristics and does not have the ability to extend diametrically and then return to the expanded position, an elastic element is featured inside the chamber 7.

In this document, the term 'multi-layer film' means a coupled structure (adhesive or extrusion coating) formed of four, three, or two films. For example, the multi-layer film can be: PET/Al/OPA/PE, PET/Al/OPA/PP, OPA/Al/PE or PP-PET/Al/PE or PP, PET/PE or PET/PP.

Advantageously, the elastic element may be configured as shown in FIG. 12. It can feature a plurality of flexible bands 11A, which connect a first annular element 11B and a second annular element 11C, with a more rigid conformation than the bands 11A.

More specifically, hooking elements 11D (preferably toothed) can extend from the first annular element and cooperate (for example with a snap mechanism) with a further flange 50 which extends from the valve body 4A.

An external cylindrical surface 50A of the flange, and also—advantageously—an external also cylindrical part of the first annular element 11B, can form a surface S where the second portion 13B of the deformable wall 6 is welded to the valve body 4A.

The welding may be carried out with conventional techniques, such as ultrasound, heat sealing, laser etc.

Next to the supply conduit 9, the valve body may feature another (advantageously cylindrical) surface wherein the first portion 12B of the deformable wall 6 may also be welded in addition.

It should be noted that the second annular element 11C can simply be fitted onto the valve body 4A externally and can, for example, come into contact with a step 53. This way, following a flexion of the flexible bands 11A, the second annular element can slide slightly towards the second welding zone 51.

Figure 11:
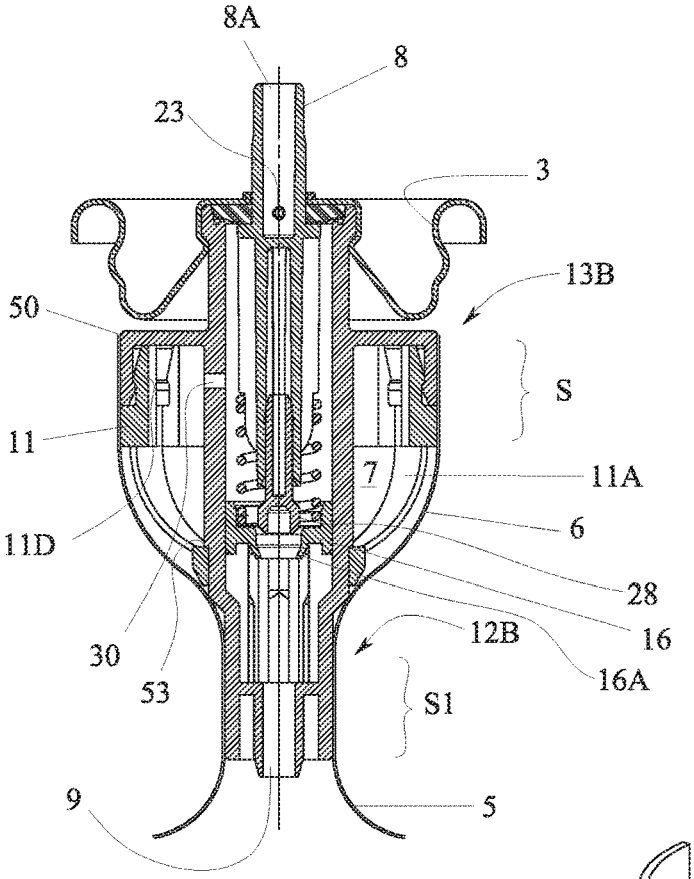
FIG. 11 shows a section of a variant of the device in FIG. 1.

In the possible configuration shown in FIG. 11, it should be noted that the deformable wall 6 is the same as that formed by the deformable bag 5.

This configuration greatly simplifies the device since, in practice, the chamber 7 is a 'sub-chamber' of the bag 5.

Obviously, however, it is not necessary, as mentioned earlier, for the fluid substance to be arranged inside the deformable bag, which may therefore not be present.

In this configuration, the supply conduit 9 will therefore be coupled with a suction tube.

Various embodiments of the innovation have been disclosed herein, but further embodiments may also be conceived using the same innovative concept.

It is evident from the above description that at least a part of the deformable wall 6 can separate the chamber 7 from the internal pressurized part of the container 2.

In other words, at least a part of the deformable wall may face (or better may directly face) the internal pressurized part of the container 2.

At least a part of the deformable wall 6 may delimit the chamber 7 at its border with the internal pressurized part of the container.

The invention claimed is:

1. A device (1) for dispensing a fluid substance, comprising a pressurized container (2) associated with a dispensing valve (4), the valve (4) having a supply conduit (9) and a stem (8) having a cavity (8A) through which the fluid substance is dispensed, a chamber (7), housed inside the container (2), and arranged so as to surround at least a part of a body (4A) of the valve (4), the chamber (7) being delimited by a deformable wall (6) and at least one part of the body (4A), the valve (4) being of the three-way type, configured so that when the stem (8) is in a first position, a cavity (8A) is isolated from the supply conduit (9) and from the chamber (7) while the supply conduit (9) is in communication with the chamber (7), wherein, when the stem (8) is in a second position, the cavity (8A) is in communication only with the chamber (7), and wherein, when the stem is in a third position, the cavity (8A) of the stem is in communication at least with the supply conduit (9), at least a part of the deformable wall (6) facing the inside of the pressurized container (2) so that when the stem (8) is in the second position the pressure inside the container (2) presses against the deformable wall (6), expelling the fluid substance contained inside the chamber (7); wherein the deformable wall (6) comprises at least a first portion (12A, 12B) permanently sealed to the body (4A) of the valve or to a suction tube associated with the body (4A) of the valve.

2. The device according to claim 1, wherein a second portion (13A) of the deformable wall (6) is sandwiched between a bottom (3) to which the valve (4) is fixed and the container (2).

3. The device according to claim 1, wherein the deformable wall (6) is made of a single piece of elastomeric material.

4. The device according to claim 1, wherein the deformable wall comprises a plurality of ribs (6A) configured to aid a perimetral extension of the deformable wall (6) inside the container (2).

5. The device according to claim 1, wherein the deformable wall (6) is made in a film welded in the first portion (12B) and in a second portion (13B) to the body (4A) of the valve.

6. The device according to claim 4, wherein the deformable wall (6) extends from a deformable bag (5), and is made of the same material of the bag or made in one piece with the bag.

7. The device according to claim 1, wherein inside the chamber (7) there is provided an elastic element (11) able to load the deformable wall (6) to extend perimetrically inside the container (2).

8. The device according to claim 1, wherein the stem (8) of the valve (4) is integral with a bulge (28) which, when positioned above or below the gasket (16) does not seal, while when in contact with the gasket (16 a seal is formed.

9. The device according to claim 1, wherein a dispensing cap (33) is fitted on the stem (8), the dispensing cap providing at least one part (33A) configured to limit in a selectable way the travel of the stem (8) to the first position, in which delivery is prevented, or to the second position in which a metered dispensing is allowed or to the third position in which a continuous dispensing is allowed.

10. The device according to claim 1, wherein inside the chamber (7) there is provided an elastic element (11) able to load the deformable wall (6) to extend perimetrically inside the container (2).

11. The device according to claim 1, wherein the stem (8) of the valve (4) is integral with a bulge (28) which, when positioned above or below the gasket (16) does not seal, while when in contact with the gasket (16) a seal is formed.

12. A device (1) for dispensing a fluid substance, comprising a pressurized container (2) associated with a dispensing valve (4), the valve (4) having a supply conduit (9) and a stem (8) having a cavity (8A) through which the fluid substance is dispensed, a chamber (7), housed inside the container (2), and arranged so as to surround at least a part of a body (4A) of the valve (4), the chamber (7) being delimited by a deformable wall (6) and at least one part of the body (4A), the valve (4) being of the three-way type, configured so that when the stem (8) is in a first position, a cavity (8A) is isolated from the supply conduit (9) and from the chamber (7) while the supply conduit (9) is in communication with the chamber (7), wherein, when the stem (8) is in a second position, the cavity (8A) is in communication only with the chamber (7), and wherein, when the stem is in a third position, the cavity (8A) of the stem is in communication at least with the supply conduit (9), at least a part of the deformable wall (6) facing the inside of the pressurized container (2) so that when the stem (8) is in the second position the pressure inside the container (2) presses against the deformable wall (6), expelling the fluid substance contained inside the chamber (7), wherein a second portion (13A) of the deformable wall (6) is sandwiched between a bottom (3) to which the valve (4) is fixed and the container (2).

13. The device according to claim 12, wherein the deformable wall (6) comprises at least a first portion (12A, 12B) permanently sealed to the body (4A) of the valve or to a suction tube associated with the body (4A) of the valve.

14. The device according to claim 12, wherein the deformable wall (6) is made of a single piece of elastomeric material.

15. The device according to claim 12, wherein the deformable wall comprises a plurality of ribs (6A) configured to aid a perimetral extension of the deformable wall (6) inside the container (2).

16. The device according to claim 12, wherein the deformable wall (6) is made in a film welded in the first portion (12B) and in a second portion (13B) to the body (4A) of the valve.

17. The device according to claim 16, wherein the deformable wall (6) extends from a deformable bag (5), and is made of the same material of the bag or made in one piece with the bag.

18. The device according to claim 12, wherein a dispensing cap (33) is fitted on the stem (8), the dispensing cap providing at least one part (33A) configured to limit in a selectable way the travel of the stem (8) to the first position, in which delivery is prevented, or to the second position in which a metered dispensing is allowed or to the third position in which a continuous dispensing is allowed.

* * * * *